US010123922B2

(12) United States Patent
Gingras et al.

(10) Patent No.: US 10,123,922 B2
(45) Date of Patent: Nov. 13, 2018

(54) WHEELCHAIR SEAT ASSEMBLY

(71) Applicant: MOTION COMPOSITES INC, Saint-Roch-de-l'Achigan (CA)

(72) Inventors: David Gingras, Lachenaie (CA); Pierre-Andre Couture, Montreal (CA); Luc Henault, Saint-Roch-de-l'Achigan (CA)

(73) Assignee: MOTION COMPOSITES INC, Saint-Roch-de-l'Achigan (CA)

( * ) Notice: Subject to any disclaimer, the term of this patent is extended or adjusted under 35 U.S.C. 154(b) by 0 days.

(21) Appl. No.: 15/521,135

(22) PCT Filed: Oct. 22, 2015

(86) PCT No.: PCT/CA2015/051075

§ 371 (c)(1),
(2) Date: Apr. 21, 2017

(87) PCT Pub. No.: WO2016/061693

PCT Pub. Date: Apr. 28, 2016

(65) Prior Publication Data

US 2017/0333268 A1 Nov. 23, 2017

Related U.S. Application Data

(60) Provisional application No. 62/067,084, filed on Oct. 22, 2014.

(51) Int. Cl.
*A61G 5/02* (2006.01)
*A61G 5/10* (2006.01)
(Continued)

(52) U.S. Cl.
CPC ..... *A61G 5/1056* (2013.01); *A61G 5/02* (2013.01); *A61G 5/1062* (2013.01);
(Continued)

(58) Field of Classification Search
CPC .. A61G 5/1056; A61G 5/1064; A61G 5/1062; A61G 5/02; A47C 4/283; A47C 4/28; A47C 4/42
See application file for complete search history.

(56) References Cited

U.S. PATENT DOCUMENTS 4,741,547 A 5/1988 Tholkers
5,143,391 A 9/1992 Robertson et al.
(Continued)

*Primary Examiner* — Kevin Hurley
*Assistant Examiner* — Marlon A Arce
(74) *Attorney, Agent, or Firm* — Norton Rose Fulbright Canada LLP

(57) ABSTRACT

A seat assembly for wheelchair of the type having a structure expandable from a contracted condition to an expanded position comprises a pair of tubular members connected to the structure. Each tubular member has a main tubular body, a secondary tubular body parallel to and inside the main tubular body, and an elongated slit extending along both the main tubular body and the secondary tubular body and common to both the main tubular body and the secondary tubular body. The slits open into an inner channel of the secondary tubular body. The main tubular body and the secondary tubular body form a hollow integral piece of composite material. A panel, e.g., of non-rigid material has rods on its opposite edges, the rods having a diameter smaller than that of the secondary tube and larger than a width of the slit to be held captive in the secondary tube, whereby the panel extends through the slit.

18 Claims, 8 Drawing Sheets

(51) Int. Cl.
*A47C 4/42* (2006.01)
*A47C 4/28* (2006.01)

(52) U.S. Cl.
CPC ..... *A61G 5/1064* (2013.01); *A47C 4/28* (2013.01); *A47C 4/283* (2013.01); *A47C 4/42* (2013.01)

(56) References Cited

U.S. PATENT DOCUMENTS

| | | | | |
|---|---|---|---|---|
| 2005/0279540 | A1 | 12/2005 | Wisner et al. | |
| 2017/0246060 | A1* | 8/2017 | Miller | A61G 5/1059 |
| 2017/0273840 | A1* | 9/2017 | Melgarejo | A61G 5/1075 |

* cited by examiner

WHEELCHAIR SEAT ASSEMBLY

CROSS-REFERENCE TO RELATED APPLICATION

The present application claims priority on U.S. Provisional Patent Application Ser. No. 62/067,084, filed on Oct. 22, 2014, and incorporated herein by reference.

TECHNICAL FIELD

The present application relates to wheelchairs and, more particularly, to wheelchair seat assemblies.

BACKGROUND OF THE ART

Wheelchairs have evolved from being made of metallic tubes to materials with more appropriate properties, such as carbon composites. Indeed, carbon is recognized as being compliant in some directions and being lightweight, therefore giving better responsiveness to wheelchairs and adding to the comfort of the user. However, there remain challenges in using carbon tubes. Considering the resin composition of carbon, carbon composites may crack over time. Hence, the presence of points of weakness in carbon, for instance by the addition of connection holes, may have an effect on durability of composite components.

SUMMARY

It is therefore an aim of the present disclosure to provide a wheelchair seat assembly that addresses issues associated with the prior art.

Therefore, in accordance with the present disclosure, there is provided a seat assembly for wheelchair of the type having a structure expandable from a contracted condition to an expanded position, the seat assembly comprising: a pair of tubular members connected to the structure, each said tubular member having a main tubular body, a secondary tubular body parallel to and inside the main tubular body, and an elongated slit extending along both the main tubular body and the secondary tubular body and common to both the main tubular body and the secondary tubular body, the slit opening into an inner channel of the secondary tubular body, the main tubular body and the secondary tubular body forming a hollow integral piece of composite material; a panel; and rods on opposite edges of the panel, the rods having a diameter smaller than that of the secondary tube and larger than a width of the slit to be held captive in the secondary tube; whereby the panel extends through the slit.

Further in accordance with the present disclosure, webs of composite material are at junctions of main tubular body and the secondary tubular body, the webs being part of the hollow integral piece of composite material.

Still further in accordance with the present disclosure, a support subsurface is on an outer surface of the main tubular body opposite one of the webs, for the panel.

Still further in accordance with the present disclosure, wherein the panel has elongated passageways on opposite edges, and further wherein the rods are in the passageways.

Still further in accordance with the present disclosure, the slits of the tubular members are oriented away from one another.

Still further in accordance with the present disclosure, a connector is provided for each said tubular member and integral therewith, the connector projecting from an outer surface of the main tubular body and adapted to be secured to the structure of the wheelchair.

Still further in accordance with the present disclosure, the connector is oriented diametrically opposite to the slit.

Still further in accordance with the present disclosure, the main tubular body is laid up onto a performed body of the secondary tubular body, whereby the main tubular body is a blowmolded body over the performed body.

Still further in accordance with the present disclosure, fibers of the composite material of the main tubular body are in a crossed pattern with fibers of the composite material in the secondary tubular body.

Still further in accordance with the present disclosure, the panel is a seat portion of a seat of the wheelchair.

Still further in accordance with the present disclosure, at least one insert is received in another inner channel defined between an inner surface of the main tubular body and an outer surface of the secondary tubular body, the at least one insert serving as an interface between a component or accessory and the tube.

Still further in accordance with the present disclosure, a second slit extends along the main tubular body and opening into the other inner channel.

Still further in accordance with the present disclosure, the panel is a backrest portion of a seat of the wheelchair.

In accordance with the present disclosure, there is provided a wheelchair structure comprising: a pair of cross-brace members pivotally connected to one another; side frame tubular assemblies operatively connected to a first end of a respective one of the cross-brace members so as to displaceable from a contracted condition to an expanded position relative to one another by pivoting movement of the cross-brace members; a seat assembly as defined above, wherein each of the tubular members is connected to a second end of a respective one of the cross-brace members.

In accordance with another embodiment of the present disclosure, there is provided a seat assembly for wheelchair for the type having a structure expandable from a contracted condition to an expanded position, the seat assembly comprising: a pair of tubes, each said tube having an elongated body, a pair of elongated slits extending along opposite sides the tube, the slits each opening into respective elongated inner channels of the tube, each tube forming a hollow integral piece of composite material; a panel; rods on opposite edges of the panel, the rods having a diameter smaller than that of a first of the channels and larger than a width of a respective one of the slits to be held captive in the first of the channels, whereby the panel of non-rigid material extends through the slit; and at least one insert received in a second one of the channels and serving as an interface between a component or accessory and the tube.

Still further in accordance with the present disclosure, the panel has elongated passageways on opposite edges, and further wherein the rods are in the passageways.

Still further in accordance with the present disclosure, the slits of each said tube are diametrically opposite one another.

Still further in accordance with the present disclosure, the panel is a backrest portion of a seat of the wheelchair.

DETAILED DESCRIPTION

Figure 1:
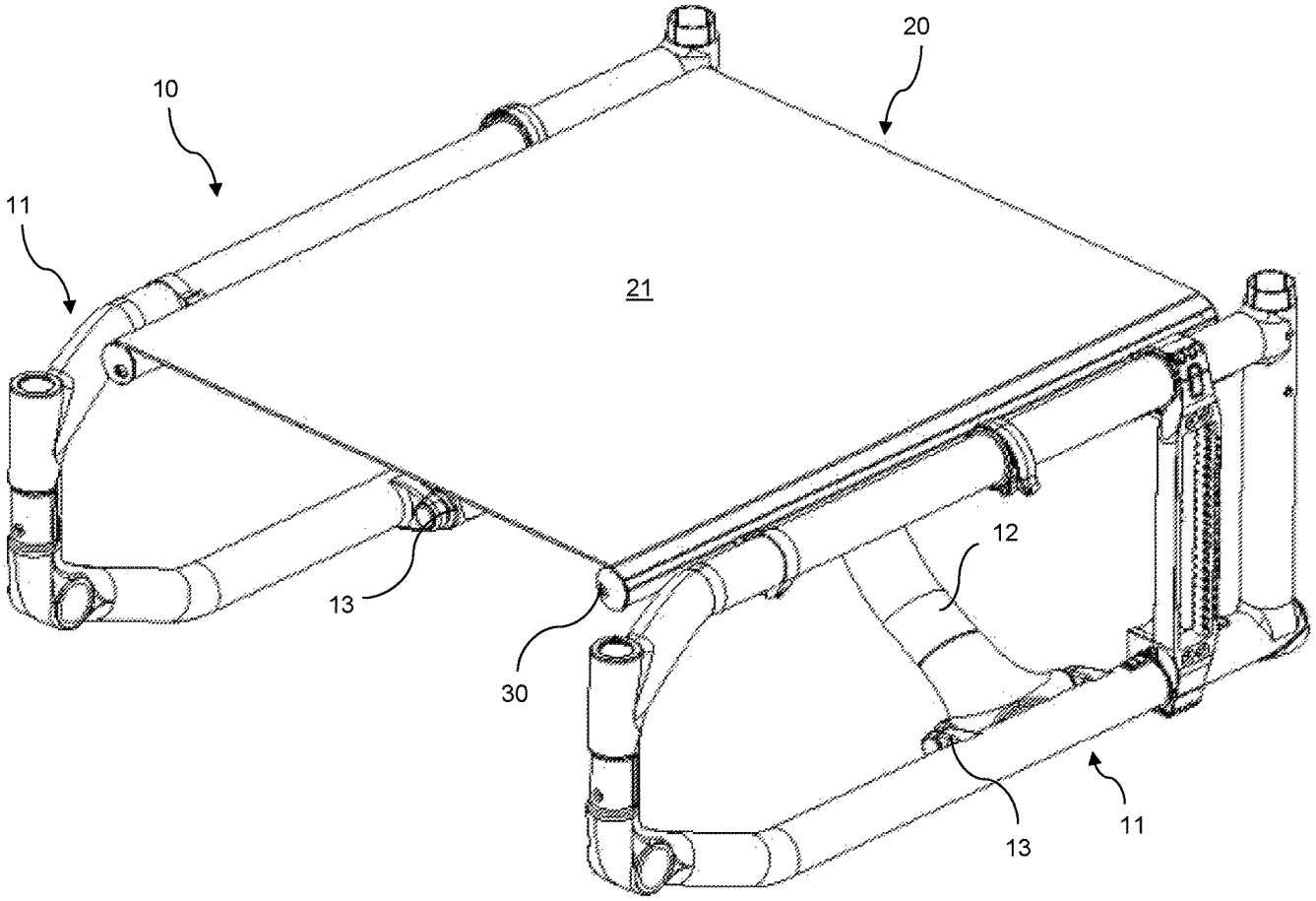
FIG. 1 is a perspective view of a wheelchair seat frame with seat assembly in accordance with the present disclosure.
Figure 2:
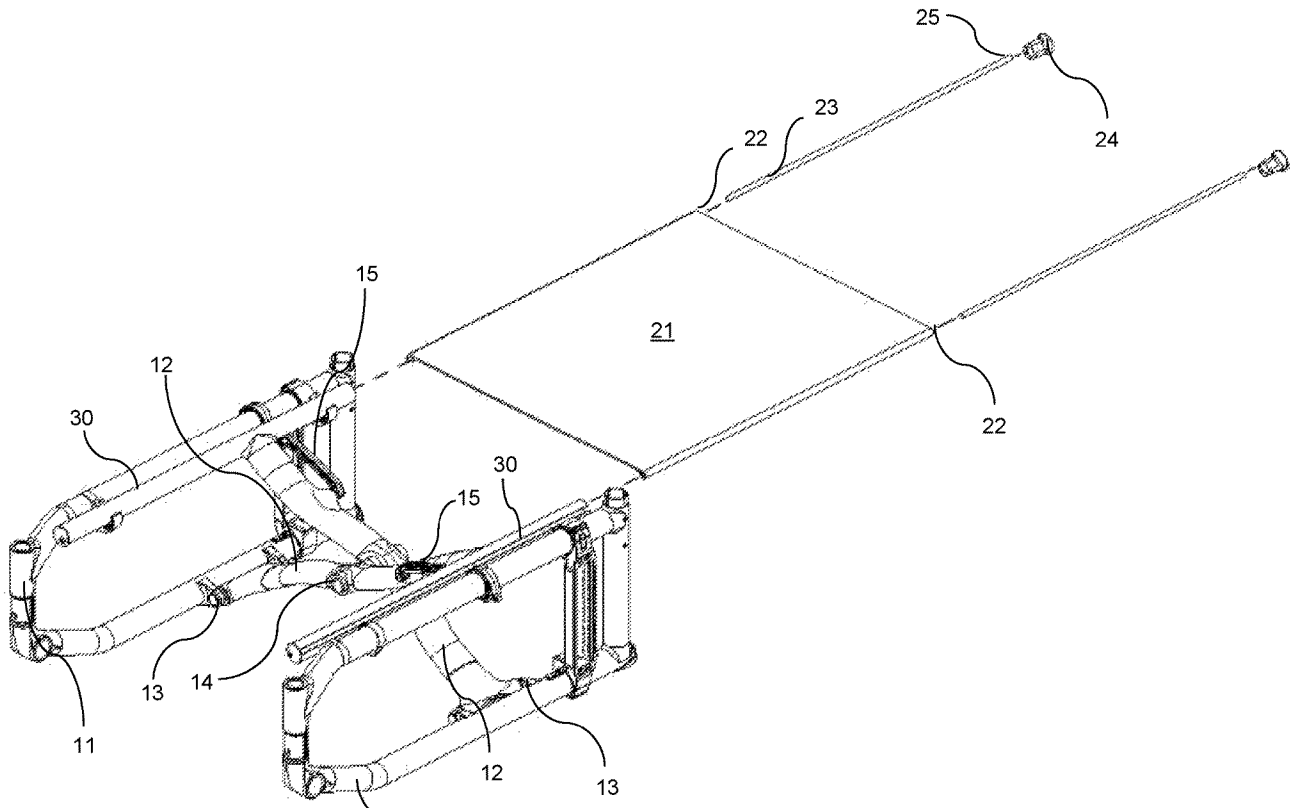
FIG. 2 is an assembly view of the wheelchair seat frame with seat assembly of FIG. 1.
Figure 6:
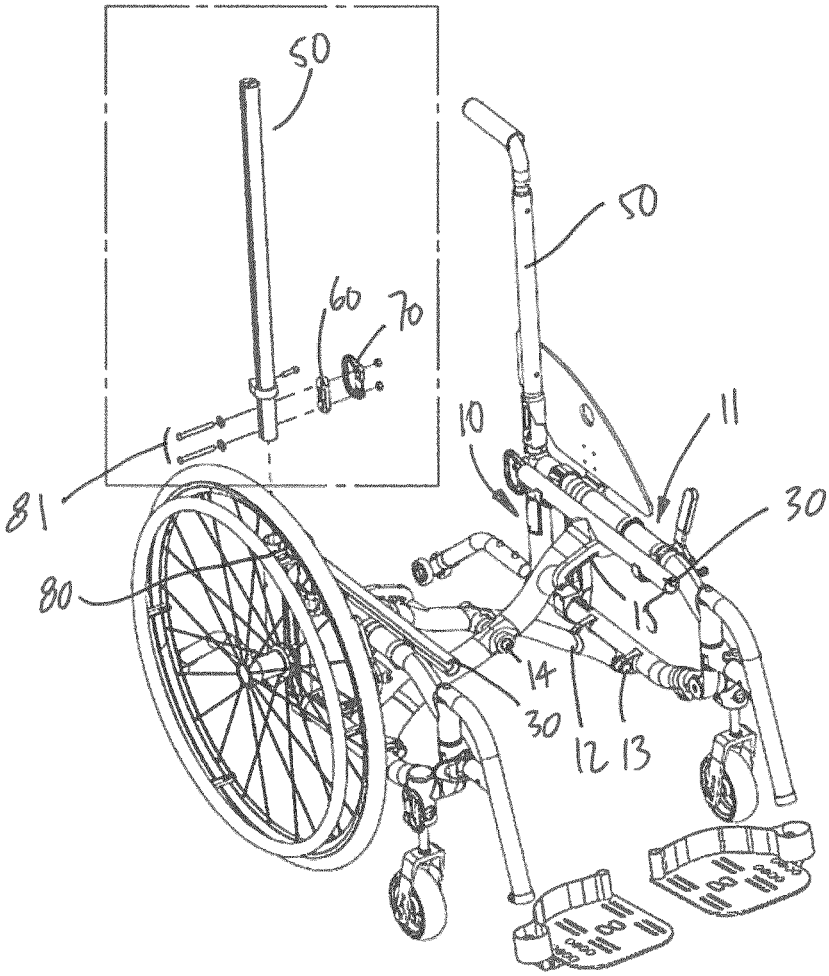
FIG. 6 is a perspective view of a wheelchair with the wheelchair seat frame of FIG. 1.

Referring to the drawings and more particularly to FIGS. 1 and 2, there is illustrated a wheelchair seat frame at 10. For simplicity, many components of a standard wheelchair have been removed but are assembled to the wheelchair seat frame 10 of FIGS. 1 and 2 during normal use of the wheelchair. A full wheelchair featuring the wheelchair seat frame 10 is shown in FIG. 6 as an example.

The wheelchair seat frame 10 has a pair of side frame tubular assemblies 11. The side frame tubular assemblies 11 are displaceable with respect to one another as the wheelchair seat frame 10 has the capability of being folded. As seen in FIG. 2, a pair of cross-brace members 12 therefore interconnects the side frame tubular assemblies 11 with one another (also known as X-brace). Each of the cross-brace members 12 has a hinge unit 13 by which it is interfaced to a respective side frame tubular assembly 11. The hinge units 13 therefore allow pivoting motion of the cross-brace members 12 with respect to a bottom tubular member of a respective side frame tubular assembly 11. It is observed that a pivoting axis is typically parallel to a direction of the bottom tubular member of the side frame tubular assembly 11 to which it is connected. A common pivot 14 interconnects the cross-brace members 12, and provides the rotational degree of freedom between the cross-brace members 12, enabling the folding of wheelchair seat frame 10. Alternative embodiments are considered, such as the used of telescopic tubes, to enable an expansion/contraction of the wheelchair seat frame 10.

Flexible link rods 15 are at top ends of the cross-brace members 12. The flexible link rods 15 are the interface between the top ends of the cross-brace members 12 with top tubes of the side frame tubular assemblies 11, and are used to lock the cross-brace members 12 to the top tubes of the side frame tubular assemblies 11. For further description, reference is made to U.S. Pat. No. 8,628,108, incorporated herein by reference. In essence, the side frame tubular assemblies 11 may be brought toward one another or may be displaced and held spaced apart in the manner shown in FIGS. 1 and 2 by the cross-brace members 12 and flexible link rods 15.

During use, with an occupant seated in the wheelchair seat frame 10, the side frame tubular assemblies 11 are held spaced apart in the manner shown in FIGS. 1 and 2, so as to hold taut a panel 21 of a seat assembly 20. The panel 21 is typically a textile, canvas or a panel of fabric or like non-rigid material that will act as a seat for the occupant of the wheelchair. It is also contemplated to use rigid panels. The panel 21 may consist of any appropriate flexible material, such as nylon for example. Elongated passageways 22 extend along the side edges of the panel 21. The elongated passageways 22 may simply be edges of the panel 21 folded over and sewn or stitched thereto, although alternative configurations are considered as well. The elongated passageways 22 are open at least at one end to receive rods 23 therein, as shown in FIG. 2. Plugs 24 and fasteners 25 may also be provided so as to secure the panel 21 with rods 23 in the elongated passageways 22 in the seat assembly 20. It is observed that the seat assembly 20 is held by top ends of the cross-brace members 12. Accordingly, when the cross-brace members 12 are pivoted to a folded configuration, the panel 21 is no longer held in a taut state but is rather loose.

Referring to FIGS. 2 to 5, the panel 21 is held taut by a pair of composite seat tubes 30 (a.k.a., tubular members) that are part of the seat assembly 20. The seat tubes 30 each have a main tubular body 31. Each of the main tubular body 31 is substantially elongated. A slit 32 extends along the full length of the main tubular body 31, although it is considered to have a closed end for the slit as opposed to having it open to both ends of the main tubular body 31. The slit 32 opens into an inner channel 33. It is observed from FIGS. 3 and 4 that a secondary tubular body 34 is located inside the main tubular body 31. The secondary tubular body 34 defines the channel 33, and shares the slit 32 with the main tubular body 31. Accordingly, the secondary tubular body 34 has a lesser inner diameter than the main tubular body 31. Moreover, it is observed that the central longitudinal axis of the secondary tubular body 34 is in an eccentric and parallel relation to the central longitudinal axis of the main tubular body 31.

Webs 35 are formed on opposite sides of the junction between the secondary tubular body 34 and the main tubular body 31. The webs 35 result from the addition of composite masses inserted at the junction between the secondary tubular body 34 and the layup of the main tubular body 31, with composite sheet layers inserted in the tubular body 31 and laid-up to overlap/cover the composite masses, a portion of the tubular body 34 and of the main tubular body 31. This arrangement is then blowmolded, resulting in the monolithic section shown in FIG. 4 (a.k.a., monocoque). Hence, the webs 35 are essentially an additional thickness of material, in such a way that the junction between the main tubular body 31 and the secondary tubular body 34 is reinforced by being thicker than the individual thicknesses of the main tubular body 31 and the secondary tubular body 34. Support surfaces 36 are defined on the outer surface of the main tubular body 31 and are generally aligned with the web 35.

Hence, the seat tubes 30 are mostly, if not completely, made of a composite material (e.g., carbon fiber and epoxy, glass fibers, kevlar). Due to the presence of a pair of tubular bodies, the tube 30 has sufficient structural integrity to sustain seat weight, while being lightweight due to the hollowness of the seat tube 30 between the main tubular body 31 and the secondary tubular body 34. Moreover, the orientation of the fibers in the tubular bodies 31 and 34 is arranged to be in a crossing pattern, to provide additional strength to the monolithic structure. The main tubular body 31 therefore retains the weight of a user, while the tubular body 34 ensures that the body 31 maintains its shape (and that the width of the slit 32 is preserved). According to an embodiment, the main tubular body 31 and web 35 are laid up onto the already-formed secondary tubular body 34. More specifically, the secondary tubular body 34 may be formed onto a mandrel, without any longitudinal slit. Then, the material of the main tubular body 31 and of the web 35 is laid-up about the secondary tubular body 34 to be blowmolded into a monolithic piece, with particular attention being put into having a different fiber orientation between the main tubular body 31 and the secondary tubular body 34. The slit 32 may then be machined in the manner shown in FIG. 4. Other methods are considered as well, such as molding both tubular bodies 31 and 34 separately, and blowing them together, for instance with the webs 35 if they are present in the tube 30, or involving mandrel wrapping.

In light of a use for supporting seat weight, the composite material may have the following characteristics:

3K carbon fiber composite

Wall thickness of tubular body 31=1.60 mm

Wall thickness of tubular body 34=1.45 mm

Outside diameter of tubular body 31=25.40 mm

Outside diameter of tubular body 34=12.80 mm

Slit width=5.08 mm

Tube 30 length=508 mm

These values are given only as an example, and may vary. For instance, a 25% variation on these dimensions is considered.

Figure 3:
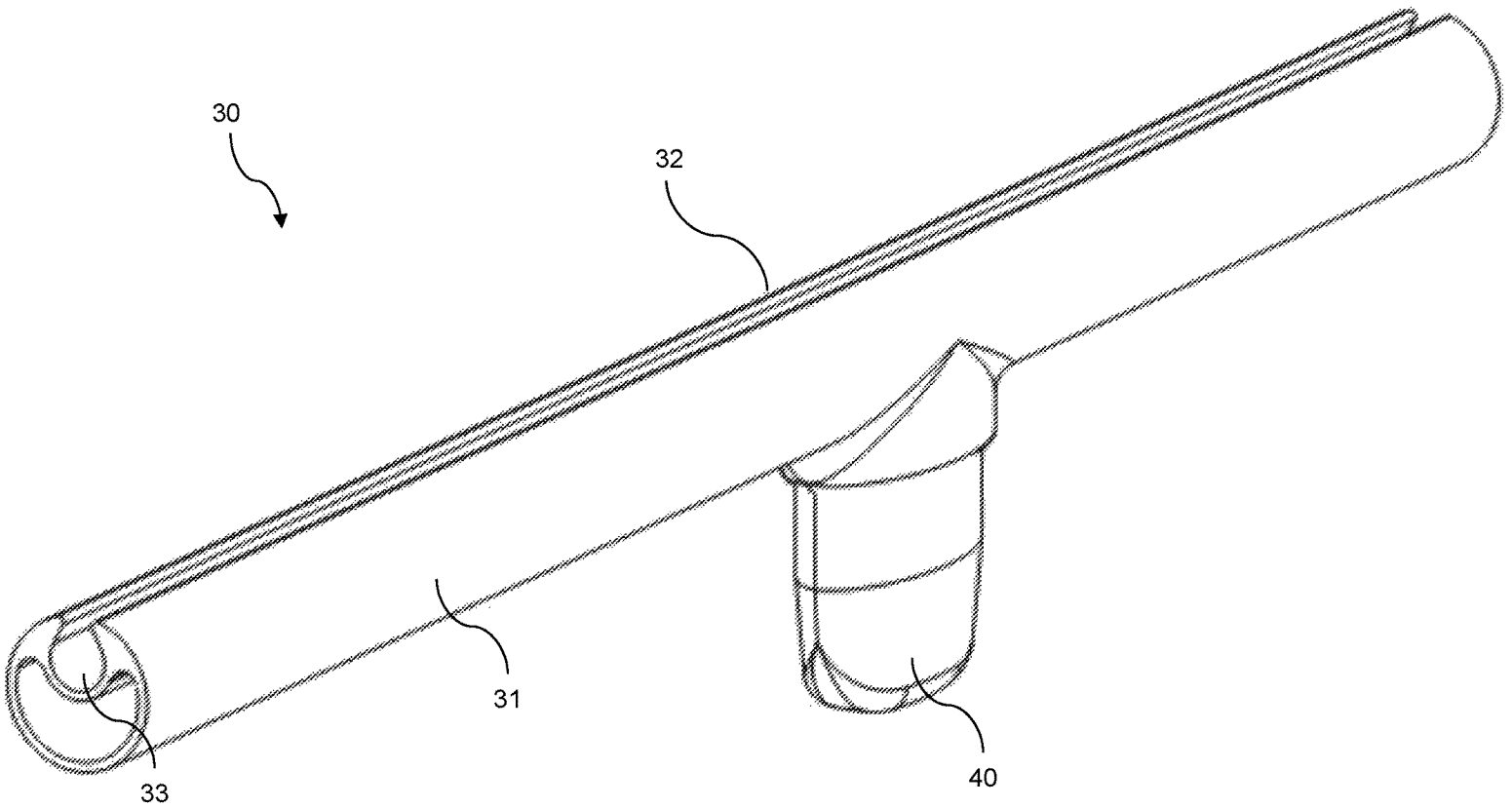
FIG. 3 is a perspective view of a seat tube of the seat assembly of the present disclosure.

Referring to FIG. 3, a connector is shown projecting radially from the seat tube 30. In the embodiment of FIG. 3, the connector 40 is diametrically opposed to the slit 32. Accordingly, by way of the connectors 40, the seat tube 30 may be connected to a hollow end of the respective cross-brace member 12, in the manner shown in FIG. 2. The connectors 40 may be composite material integral with the seat tube 30, among other possibilities. Alternatively, the seat tube 30 may be integrally connected to its cross-brace member 12, i.e., a monolithic integral piece.

Figure 4:
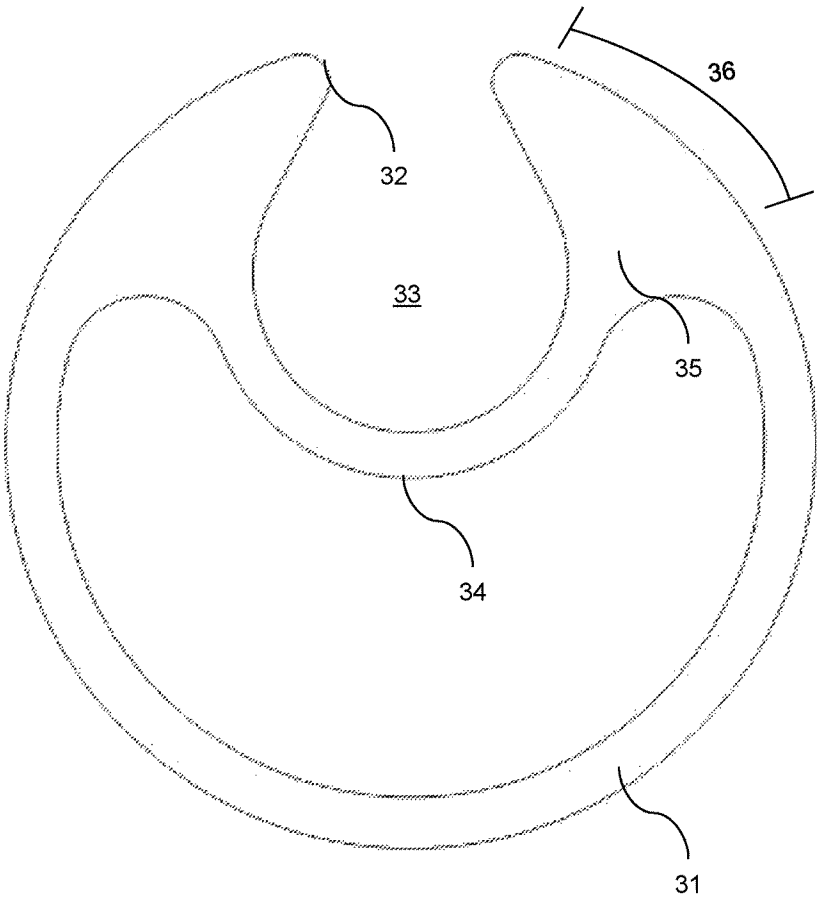
FIG. 4 is an end view of the seat tube of FIG. 3.
Figure 5:
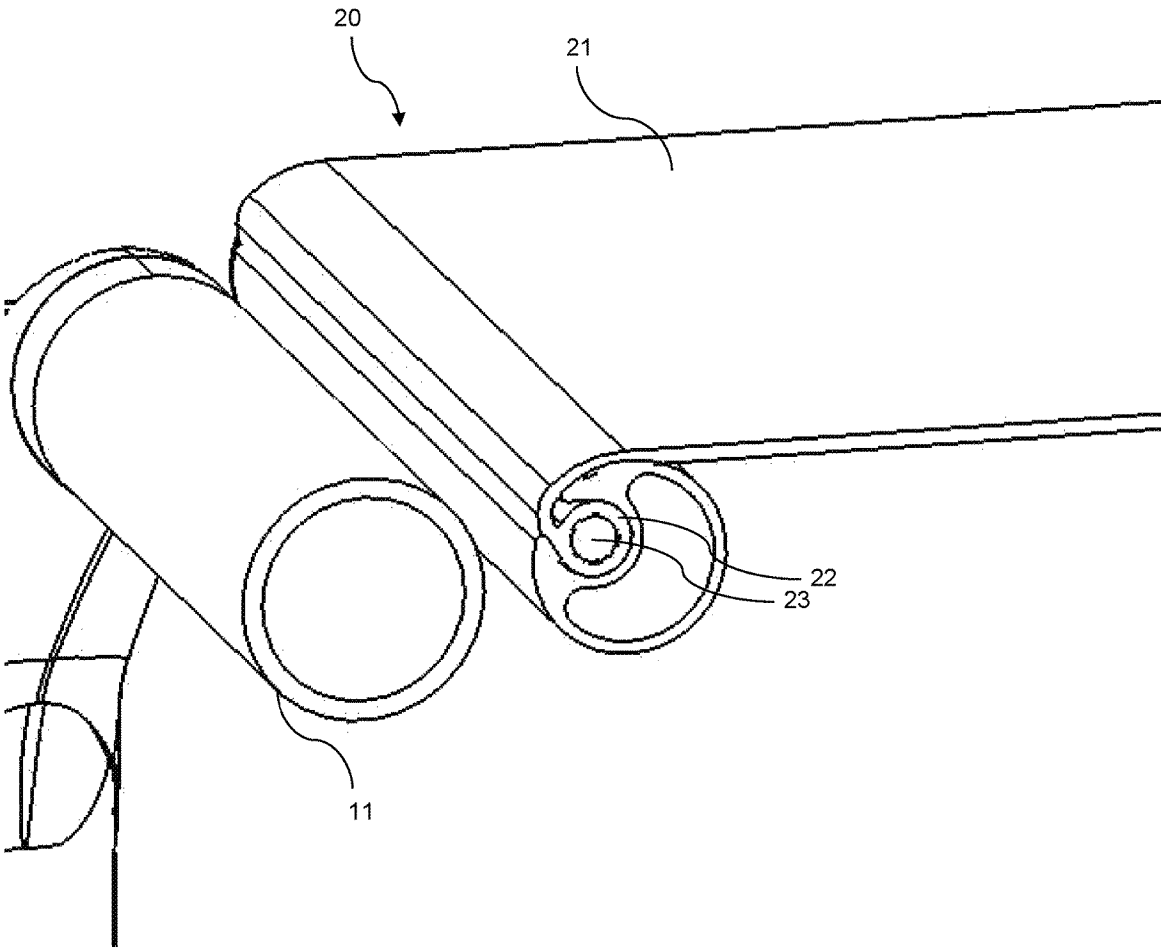
FIG. 5 is an enlarged perspective view illustrating an assembly of components of the seat assembly of FIG. 2.

Therefore, in the manner shown in FIG. 5, the lateral edges of the panel 21 are inserted with the rods 23 in the secondary tubular body 34 as having been inserted via the slit 32. Accordingly, the rod 23 is held in the channel 33 and holds the panel 21 captive therein, by having a diameter that is larger than the width of the slit 32. It is observed that the orientation of the connector 40 has the slit 32 offset from being vertical. More specifically, FIG. 4 shows the slit 32 pointing to a vertical direction. However, as observed from FIG. 5, the slit 32 does not face substantially upwardly when the panel 21 is taut, as in FIG. 5. By having the slits 32 oriented away from one another in the manner shown in FIG. 5, a subsurface of the seat tube 30 serves as a support surface for the panel 21, such that a load on the panel 21 is partially distributed to the outer surface of the seat tube 30.

Due to the extensive surface of contact between the rod 23 and the inner surface of the channel 33, the rod 23 may be made of a plastic material or lightweight metallic material, among other possibilities, and need not be excessively large.

In order to assemble the seat assembly 20, the rods 23 are received in the respective elongated passageways 22 of the panel 21. The assembly may then be slid into engagement in the manner shown in FIG. 2, whereby the elongated passageways 22 and rods 23 are received in the channels 33 with the panel 21 passing through the slits 32. This is preferably done when the wheelchair seat frame 10 is in a folded condition.

Thereafter, the plugs 24 may be inserted to ensure that the rods 23 remain captive in the seat tubes 30. It may be necessary to use fasteners 25, which fasteners may be screwed into the material of seat tube 30.

While the above describes the use of the seat tubes 30 for seat applications, it is considered to use the seat tubes 30 as part of a back rest. Referring to FIG. 6, there is illustrated a wheelchair seat frame 10 having a pair of the seat tubes 30, as well as a pair of backrest tubes 50. FIG. 6 does not show a panel being held taut by the backrest tubes 50, but this may be achieved in similar fashion to the tubes 30 and panel 21 as in FIG. 1.

Figure 7:
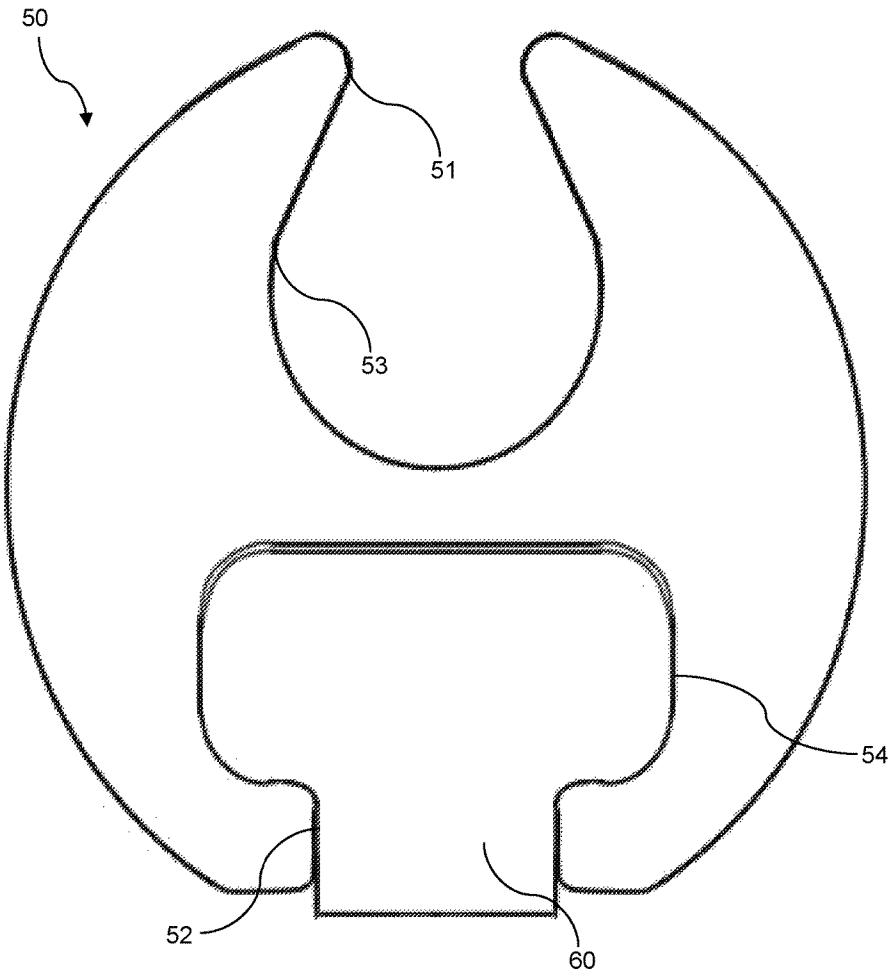
FIG. 7 is a sectional view of a backrest tube and insert in accordance with another embodiment of the present disclosure.

Referring to FIG. 7, a sectional view of the backrest tube 50 is shown. The tube 50 has an elongated body. Slits 51 and 52 extend along the full length of the tube 50 and are diametrically opposed. The slits 51 and 52 respectively open into channels 53 and 54. It is observed from FIGS. 3 and 4 that a secondary tubular body 34 is located inside the main tubular body 31. The channel 53 has a generally circular sectional shape, whereas the channel 54 has a generally rectangular shape. These are two of numerous possible shapes considered for the channels. For example, the channels 53 and 54 may have the same sectional shape. The tube 50 may be fabricated as a monolithic (a.k.a., monocoque) piece with the composite material being laid up to the sectional shape of FIG. 7, for subsequent blowmolding. Other methods are considered as well, such as the machining of the slits 51 and 52 in a tube having the channels 53 and 54 (resulting from the use of a pair of mandrels). It is observed that the tube 50 is hollow, by way of the slits 51 and 52 and the channels 53 and 54.

Referring to FIG. 7, in addition to the contemplated use with a panel (e.g., in the manner shown in FIG. 1 for the panel 21 and tubes 30), the tube 50 may be used with an insert 60. The insert 60 may consist of any appropriate material, and may have different functions. For example, the insert 60 is shaped to be received in the channel 54 by its shape, but may alternatively be shaped to fit into the channel 53. The insert 60 may therefore serve as a support block, for instance to receive fasteners (e.g., bolts, screws). In an embodiment, the insert 60 incorporates a nut such that bolts may be used to fasten components to the insert 60 and thus to the tube 50. FIG. 6 shows such an example, with the insert 60 used with loop 70. In FIG. 6, the insert 60 is received in the channel 53. The insert 60 may serve to support armrests, a thoracic support, or may be used to attach accessories to the wheelchair, such as a bag, a cane, a tensioning bar, wheelchair handles, etc. Accordingly, there may be more than one insert 60 per tube 50. It is also pointed out that the seat tubes 30 may adopt the configuration of the tube 50, i.e., a pair of channels per tube 30.

Figure 8:
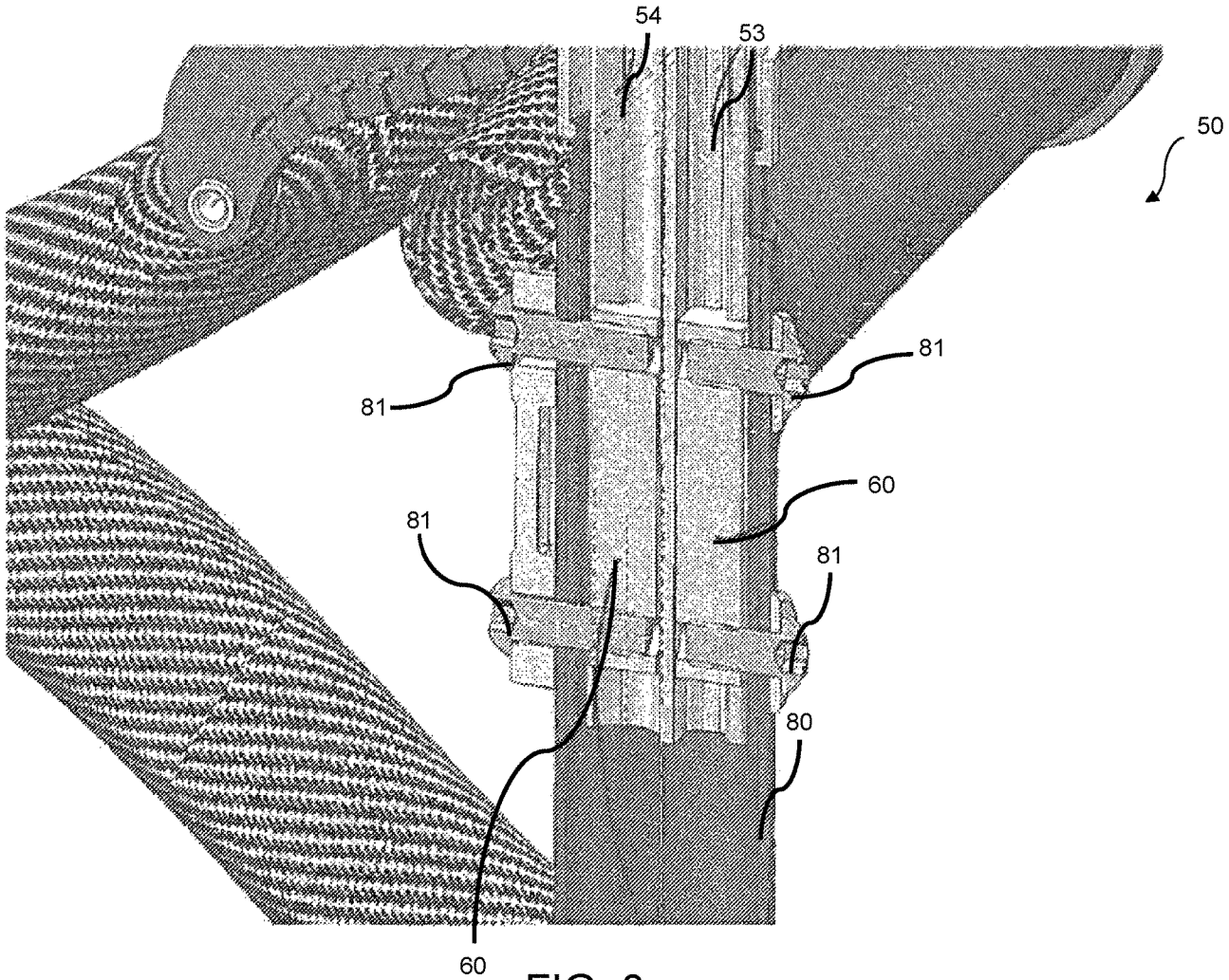
FIG. 8 is a perspective view, partly sectioned, of the backrest tube of FIG. 7 as secured to the wheelchair seat frame of FIG. 6.

Referring to FIG. 8, a pair of inserts 60 are respectively received in the channels 53 and 54, and may be used to fix the tube 50 to a vertical tube 80 of the wheelchair seat frame 10. In such a case, the tube 50 is telescopically received in the vertical tube 80, and fasteners 81 pull the inserts 60 radially outwardly by cooperating with a wall of the vertical tube 80. As a result, the tube 50 is sandwiched between the inserts 60 and the vertical tube 80 and, as such, holds its vertical position.

The invention claimed is:

1. A seat assembly for wheelchair of the type having a structure expandable from a contracted condition to an expanded position, the seat assembly comprising:

a pair of tubular members connected to the structure, each said tubular member having a main tubular body, a secondary tubular body parallel to and inside the main tubular body, and an elongated slit extending along both the main tubular body and the secondary tubular body and common to both the main tubular body and the secondary tubular body, the slit opening into an inner channel of the secondary tubular body, the main tubular body and the secondary tubular body forming a hollow integral piece of composite material;

a panel; and rods on opposite edges of the panel, the rods having a diameter smaller than that of the secondary tube and larger than a width of the slit to be held captive in the secondary tube;

whereby the panel extends through the slit.

2. The seat assembly according to claim 1, further comprising webs of composite material at junctions of main tubular body and the secondary tubular body, the webs being part of the hollow integral piece of composite material.

3. The seat assembly according to claim 2, further comprising a support subsurface on an outer surface of the main tubular body opposite one of the webs, for the panel.

4. The seat assembly according to claim 1, wherein the panel is made of a non-rigid material and has elongated passageways on opposite edges, and further wherein the rods are in the passageways.

5. The seat assembly according to claim 1, wherein the slits of the tubular members are oriented away from one another.

6. The seat assembly according to claim 1, further comprising a connector for each said tubular member and integral therewith, the connector projecting from an outer surface of the main tubular body and adapted to be secured to the structure of the wheelchair.

7. The seat assembly according to claim 6, wherein the connector is oriented diametrically opposite to the slit.

8. The seat assembly according to claim 1, wherein the main tubular body is laid up onto a performed body of the secondary tubular body, whereby the main tubular body is a blowmolded body over the performed body.

9. The seat assembly according to claim 1, wherein fibers of the composite material of the main tubular body are in a crossed pattern with fibers of the composite material in the secondary tubular body.

10. The seat assembly according to claim 1, wherein the panel is a seat portion of a seat of the wheelchair.

11. The seat assembly according to claim 1, further comprising at least one insert received in another inner channel defined between an inner surface of the main tubular body and an outer surface of the secondary tubular body, the at least one insert serving as an interface between a component or accessory and the tube.

12. The seat assembly according to claim 11, further comprising a second slit extending along the main tubular body and opening into the other inner channel.

13. The seat assembly according to claim 1, wherein the panel is a backrest portion of a seat of the wheelchair.

14. A wheelchair structure comprising:

a pair of cross-brace members pivotally connected to one another;

side frame tubular assemblies operatively connected to a first end of a respective one of the cross-brace members so as to displaceable from a contracted condition to an expanded position relative to one another by pivoting movement of the cross-brace members;

a seat assembly according to claim 1, wherein each of the tubular members is connected to a second end of a respective one of the cross-brace members.

15. A seat assembly for wheelchair for the type having a structure expandable from a contracted condition to an expanded position, the seat assembly comprising:

a pair of tubes, each said tube having an elongated body, a pair of elongated slits extending along opposite sides the tube, the slits each opening into respective elongated inner channels of the tube, each tube forming a hollow integral piece of composite material;

a panel;

rods on opposite edges of the panel, the rods having a diameter smaller than that of a first of the channels and larger than a width of a respective one of the slits to be held captive in the first of the channels, whereby the panel extends through the slit; and at least one insert received in a second one of the channels and serving as an interface between a component or accessory and the tube.

16. The seat assembly according to claim 15, wherein the panel is made of a non-rigid material and has elongated passageways on opposite edges, and further wherein the rods are in the passageways.

17. The seat assembly according to claim 15, wherein the slits of each said tube are diametrically opposite one another.

18. The seat assembly according to claim 15, wherein the panel is a backrest portion of a seat of the wheelchair.

* * * * *